US005180302A

United States Patent [19]

Schwartz et al.

[11] Patent Number: 5,180,302

[45] Date of Patent: Jan. 19, 1993

[54] RADIANT GAS BURNER AND METHOD

[75] Inventors: Robert E. Schwartz, Tulsa; Robert R. Trimble, Sand Springs, both of Okla.

[73] Assignee: John Zink Company, a Division of Koch Engineering Company, Inc., Tulsa, Okla.

[21] Appl. No.: 843,452

[22] Filed: Feb. 28, 1992

[51] Int. Cl.[5] ..... F23D 14/12

[52] U.S. Cl. ..... 431/348; 431/175; 431/177; 431/278

[58] Field of Search ..... 431/348, 278, 8, 175, 431/177

[56] References Cited

U.S. PATENT DOCUMENTS

| | | | |
|---|---|---|---|
| 2,667,216 | 1/1954 | Zink et al. . | |
| 2,834,407 | 5/1958 | Mason | 431/175 |
| 3,180,395 | 4/1965 | Reed | 431/175 |
| 3,217,779 | 11/1965 | Reed et al. | 431/175 |
| 3,639,095 | 2/1972 | Zink et al. | 431/177 |
| 3,684,424 | 8/1972 | Zink et al. | 431/114 |
| 3,940,234 | 2/1976 | Reed et al. | 431/348 |
| 4,125,359 | 11/1978 | Lempa | 431/175 |
| 4,257,762 | 3/1981 | Zink et al. | 431/348 |

FOREIGN PATENT DOCUMENTS

| | | |
|---|---|---|
| 63-259852 | 10/1988 | Japan . |
| 8901252 | 10/1989 | United Kingdom . |

*Primary Examiner*—Carroll B. Dority

*Attorney, Agent, or Firm*—Laney, Dougherty, Hessin & Beavers

[57] ABSTRACT

An improved radiant gas burner which includes a refractory burner tile having an elongated passageway extending therethrough and a fuel-air mixture burner tube disposed within the passageway. The burner tube is of a one-piece elongated construction, includes a nozzle portion at the interior end of the passageway and is connected to means for introducing fuel gas and air therein by a threaded connection positioned adjacent the exterior end of the passageway. Secondary fuel is discharged from the passageway at a location adjacent the nozzle portion of the burner tube. An improved method of burning fuel gas and air using a radiant gas burner is also provided.

13 Claims, 2 Drawing Sheets

RADIANT GAS BURNER AND METHOD

BACKGROUND OF THE INVENTION

1. Field of the Invention

The present invention relates to radiant gas burners, and more particularly, to an improved radiant gas burner of the type including a central burner tube surrounded by an annular refractory tile and a method of burning fuel gas and air with low $NO_x$ production.

2. Description of the Prior Art

Radiant burners of the type which include central fuel gas-air mixture burner tubes surrounded by annular refractory tiles are well known and have been utilized in conjunction with reformers, cracking furnaces and the like for many years. The refractory tiles have generally been adapted for insertion into openings in furnace walls, and the burner tubes which extend through central passageways in the burner tiles discharge fuel gas-air mixtures in directions generally parallel and adjacent to the internal faces of the burner tiles. The combustion of the fuel gas-air mixtures causes the faces of the burner tiles to radiate heat, e.g., to process tubes, and undesirable flame impingement on the process tubes is thereby avoided.

Heretofore, the nozzle portions of the burner tubes of radiant burners which extend short distances past the burner tiles have been threadedly connected to the forward portions of the tubes. However, the threaded nozzle connections have been located close to the interior faces of the burner tiles which are exposed to high temperatures, i.e., temperatures in the range of from about 1500° F. to about 2500° F. While such threaded nozzle connections were intended to allow the nozzle portions of the burner tubes to be periodically removed and replaced, because of the high temperatures the metal forming the threads has often fused and prevented the ready removal of the nozzle portions. Consequently, the more recent radiant burners have included burner tubes with the nozzle portions welded thereto. In order to change the nozzle portions of such burner tubes when they deteriorate, it is necessary to dismantle the burner apparatus, cut off the deteriorated nozzle portions and re-weld new nozzle portions thereon. Thus, there is a need for improved radiant gas burners which include readily replaceable burner tubes.

More stringent environmental emission standards are continuously being imposed by governmental authorities which limit the quantities of gaseous pollutants such as oxides of nitrogen ($NO_x$) and carbon monoxide which can be emitted into the atmosphere. Such standards have led to the development of various improved gas burner designs which lower the production of $NO_x$ and other polluting gases. While radiant gas burners have also been improved whereby combustion gases containing lower levels of pollutants are produced, additional improvement is necessary. Thus, there is also a need for an improved method of burning fuel gas and air using a radiant gas burner whereby combustion gases having lower pollutant levels are produced.

SUMMARY OF THE INVENTION

By the present invention, an improved radiant gas burner is provided which overcomes the shortcomings of the prior art and meets the needs described above. More particularly, an improved radiant gas burner of the present invention is comprised of a refractory burner tile having an elongated central passageway extending therethrough for communicating the exterior of a furnace space to the interior thereof. A fuel gas and fuel gas-air mixture manifold block is sealingly connected to the exterior end of the burner tile passageway whereby unregulated air flow from the exterior of the furnace space is prevented from entering the passageway. As a result, the $NO_x$ level in the combustion gases produced by the burner is reduced.

A one-piece elongated primary fuel gas-air mixture burner tube is disposed within the burner tile passageway having an inlet end threadedly connected to the manifold block and including a nozzle portion comprised of a closed outlet end having a plurality of circumferentially spaced openings such as orifices or longitudinal slots formed therein. The openings are preferably longitudinal slots and direct the primary fuel gas-air mixture in directions substantially parallel and adjacent to the face of the burner tile within the furnace space. Because the burner tube is elongated and the threaded connection between it and the manifold block is positioned adjacent the exterior end of the burner tile passageway, the threaded connection remains relatively cool during the operation of the burner whereby the entire burner tube can be readily removed and replaced as required.

At least one elongated secondary fuel gas discharge pipe is also disposed in the burner tile passageway and connected to the manifold block. The discharge end of the secondary fuel gas discharge pipe is positioned adjacent the outlet end of the burner tube for injecting secondary fuel gas into the furnace space resulting in a reduced $NO_x$ level in the combustion gases produced by the combustion of the total fuel gas input to the burner. Means for introducing a primary fuel gas-air mixture into the manifold block and into the burner tube and for introducing secondary fuel gas into the secondary fuel discharge pipe are attached to the manifold block. A method of burning fuel gas and air using a radiant gas burner is also provided.

It is, therefore, a general object of the present invention to provide an improved radiant gas burner and a method of burning fuel gas and air using the burner.

A further object of the present invention is the provision of a radiant gas burner which includes a one-piece burner tube which is threadedly connected to a manifold block at a position sufficiently removed from the face of the burner tile whereby the threaded connection remains cool and operable.

A further object of the present invention is the provision of an improved radiant gas burner and method which result in the production of combustion gases having relatively low levels of $NO_x$ therein.

Other and further objects, features and advantages of the present invention will be readily apparent to those skilled in the art upon a reading of the description of preferred embodiments which follows when taken in conjunction with the accompanying drawings.

DESCRIPTION OF PREFERRED EMBODIMENTS

Figure 2:
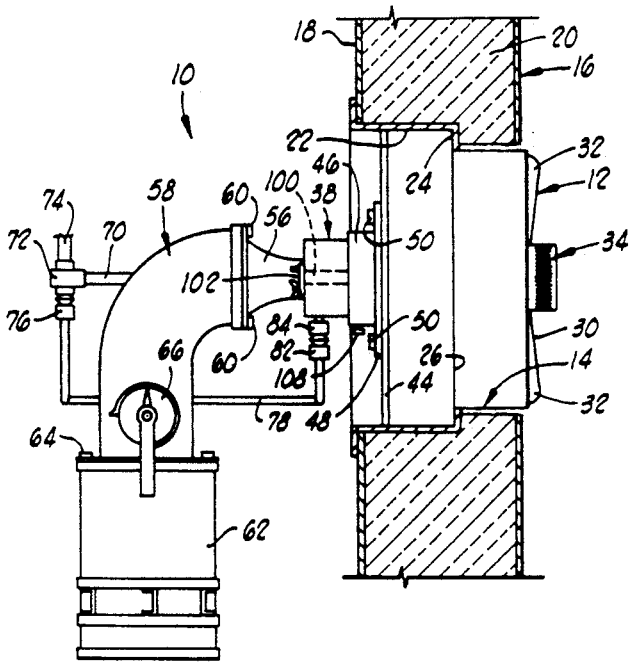
FIG. 2 is a side view of the radiant gas burner of FIG. 2 installed in a furnace wall.
Figure 4:
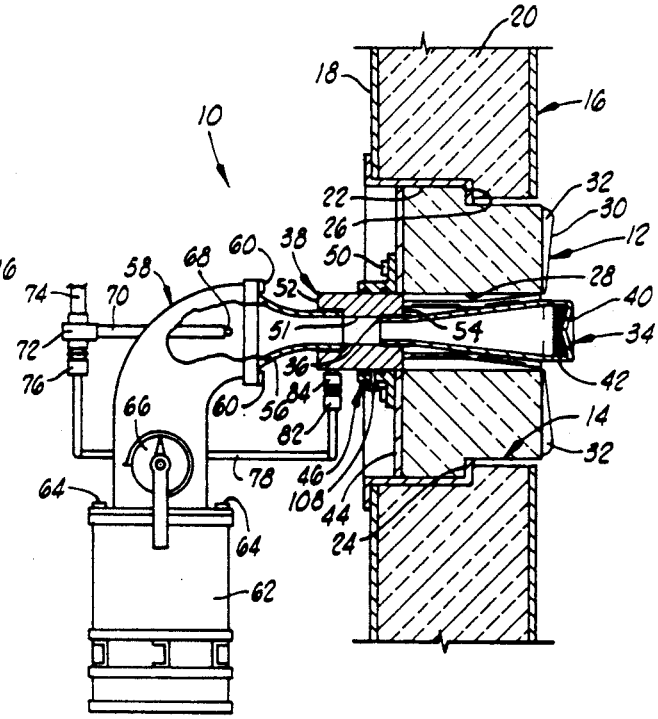
FIG. 4 is a partially sectional side view of the radiant burner of FIGS. 1, 2 and 3.

Referring now to the drawings, an improved radiant gas burner of the present invention is illustrated and generally designated by the numeral 10. The burner 10 is comprised of a burner tile 12 adapted to be inserted in an opening 14 of a furnace wall 16. While the furnace of which the wall 16 is a part is not shown, it will be understood by those skilled in the art that the wall 16 and other walls of the furnace connected thereto define an interior furnace space. As shown in FIGS. 2 and 4, the wall 16 of the furnace is comprised of an external metal sheet 18 with a relatively thick liner of refractory material 20 attached thereto. The opening 14 in the furnace wall 16 can be of various shapes. An outer portion 22 of the opening 14 can be enlarged whereby an interior shoulder 24 is formed in the opening 14. The burner tile 12 is of a complimentary peripheral shape to the opening 14 in the furnace wall 16, and in the form shown in the drawings, includes a shoulder 26 for co-acting with the shoulder 24 of the furnace wall 16.

The burner tile 12 generally includes a central elongated passageway 28 extending therethrough, and the interior face 30 of the burner tile 12 includes a plurality of substantially radially extending ribs 32 formed thereon for directing fuel and air and the combustion gases produced therefrom radially outwardly from the passageway 28.

Figure 5:
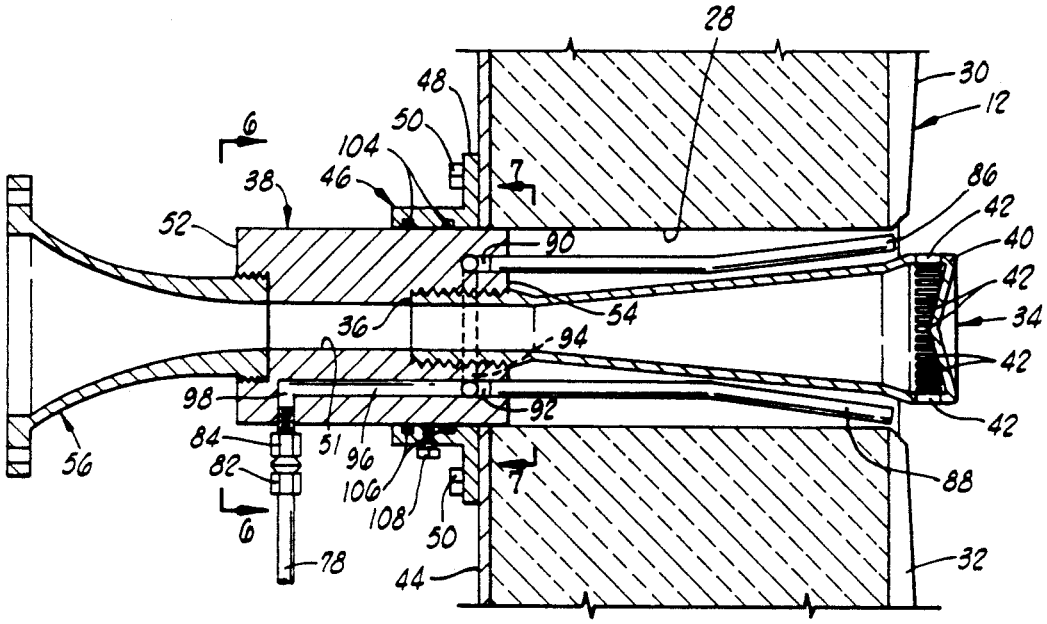
FIG. 5 is an enlarged sectional view of a portion of the burner illustrated in FIG. 4.

Disposed within the passageway 28 of the burner tile 12 is a one-piece elongated burner tube 34. As best shown in FIG. 5, the burner tube 34 has an inlet end 36 which is threadedly connected to a manifold block 38. The outlet nozzle end of the burner tube 34 is closed by a conical shaped end wall 40, and a plurality of circumferentially spaced longitudinal slots 42 are formed in the burner tube 34 adjacent the wall 40.

Adjacent to the exterior face of the burner tile 12 and supporting the burner tile 12 is a burner tile mounting plate 44 having a central opening therein complimentary in size to the passageway 28. A sleeve 46 having an interior size and shape corresponding to the size and shape of the passageway 28 and having a flange 48 positioned adjacent the plate 44 is attached to the plate 44 by a plurality of bolts 50. The manifold block 38 is of an external size and shape which are complimentary to the internal size and shape of the sleeve 46, and the interior end portion of the manifold block 38 is positioned within the sleeve 46.

Figure 6:
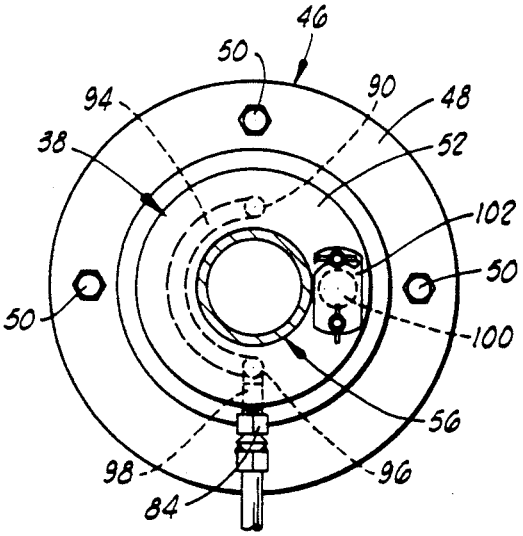
FIG. 6 is a sectional view taken along line 6—6 of FIG. 5.
Figure 7:
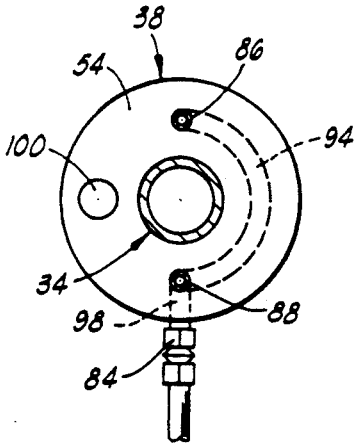
FIG. 7 is a sectional view taken along line 7—7 of FIG. 5.

The manifold block 38 includes a central passage 51 formed therein which extends from the exterior end 52 to the interior end 54 thereof (see FIGS. 5–7). As best shown in FIG. 5, the end 36 of the burner tube 34 is threadedly connected within the passage 51 at the end 54 of the manifold block 38, and an inlet bell fitting 56 is threadedly connected to the passage 51 at the other end 52 of the manifold block 38. The bell fitting 56, passage 51 and burner tube 34 form a venturi as will be described further hereinbelow.

Figure 1:
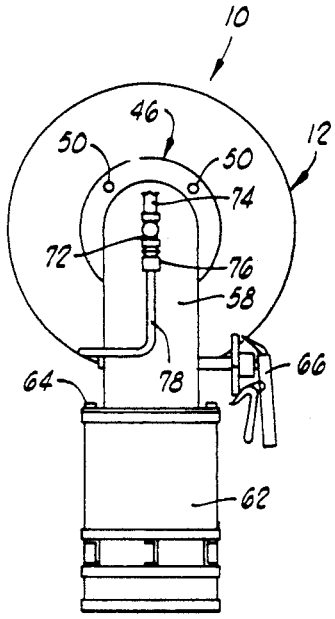
FIG. 1 is a front view of a radiant gas burner of the present invention.

Referring specifically to FIGS. 1, 2 and 4, the bell fitting 56 is connected to one end of an air conduit 58 by a plurality of bolts 60. In the form illustrated in the drawings, the conduit 58 includes a 90° bend therein and the other end thereof is attached to a muffler 62 of known design by a plurality of bolts 64. An air flow regulator valve 66 is connected to and disposed within the conduit 58 for manually regulating the rate of air flow conducted to the venturi comprising the fitting 56, manifold block 38 and burner tube 34. A primary fuel gas jet forming nozzle 68 is disposed within the conduit 58 or fitting 56 and is positioned to discharge a jet of primary fuel into the bell fitting 56. The nozzle 68 is connected to a fuel gas conduit 70 which sealingly passes through a wall of the conduit 58 and is connected to a tee 72. The tee 72 is connected to a conduit 74, the other end of which is connected to a source of pressurized fuel gas (not shown). A tubing fitting 76 having a length of tubing 78 connected thereto is connected to the tee 72. The other end of the tubing 78 is connected to a tubing fitting 82. The tubing fitting 82 is connected to a secondary fuel gas orifice fitting 84 which is in turn connected to the manifold block 38.

Referring now to FIGS. 5–7, the bell fitting 56, manifold block 38, sleeve 46 and burner tube 34 are illustrated in detail. The bell fitting 56 is threadedly connected at the exterior end 52 of the manifold block 38 within the primary fuel gas-air mixture passage 51. The threaded end 36 of the burner tube 34 is also threadedly connected within the passage 51 of the manifold block 38, but at the interior end 54 thereof. Thus, as will be described further hereinbelow, a primary fuel gas-air mixture is produced as the fuel gas jet formed by the nozzle 68 and air aspirated thereby flow through the venturi comprised of the bell fitting 56, the passage 51 in the manifold block 38 and the burner tube 34, and the mixture is discharged from the burner tube 34 by way of the longitudinal slots 42 thereof.

Figure 3:
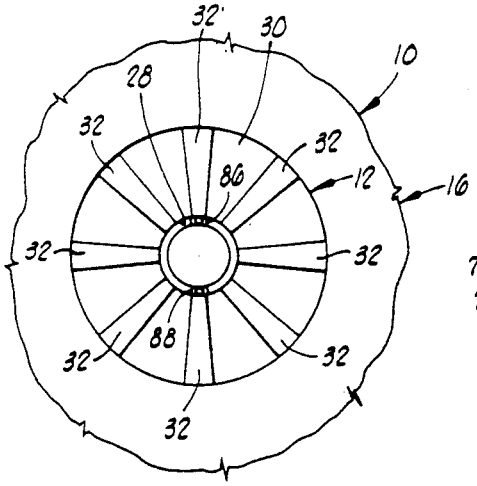
FIG. 3 is a view of the radiant gas burner of FIG. 2 from inside the furnace wall.

Disposed in the passageway 28 of the refractory burner tile 12, in addition to the burner tube 34, are a pair of secondary fuel gas discharge pipes 86 and 88. The secondary fuel gas discharge pipes 86 and 88 are generally positioned on opposite sides of the burner tube 34, and are threadedly connected to a pair of longitudinal passages 90 and 92 formed in the end 54 of the manifold block 38. The open ends of the pipes 86 and 88 terminate at positions upstream of and closely adjacent to the slots 42 in the burner tube 34 whereby secondary fuel gas discharged from the pipes 86 and 88 flows into the interior of the furnace (see FIG. 3).

The passages 90 and 92 within which the discharge pipes 86 and 88 are connected are in turn connected to a passage 94 formed internally within the manifold block 38. A longitudinal passage 96 is connected to the passage 94 and to a lateral passage 98 within which the previously described orifice fitting 84 is threadedly connected.

Referring now to FIGS. 2, 6 and 7, a longitudinal air passage 100 is formed in the manifold block 38 extending from the exterior end 52 to the interior end 54 thereof. An air flow closure and regulating assembly 102 is attached to the exterior end 52 of the manifold block 38 over the air passage 100. The assembly 102 is used for manually closing the passage 100 or opening it a desired amount whereby the air flow through the passage 100 is regulated.

As mentioned previously, a portion of the manifold block 38 is positioned within the interior of the sleeve 46. In a preferred embodiment, both the exterior portion of the manifold block 38 within the sleeve 46 and the interior of the sleeve 46 are cylindrical. In order to insure that an unregulated flow of air does not leak into the passageway 28, one or more resilient sealing members can be disposed between the exterior of the manifold block 38 and the interior of the sleeve 46. Preferably, as shown best in FIG. 5, the interior of the sleeve 46 includes a pair of grooves 104 formed therein, and a pair of O-rings 106 are disposed in the grooves 104 whereby a seal between the exterior of the manifold block 38 and the interior of the sleeve 46 is assured. A threaded bolt 108 is disposed in a threaded bore in the sleeve 46 for locking the manifold block 38 within the sleeve 46.

In operation of the burner 10, pressurized fuel gas from a source thereof is conducted by the conduit 74 to the tee 72. A portion of the fuel gas flows from the tee 72 into the primary fuel gas conduit 70 with the remaining portion flowing by way of the tubing 78 into the passage 98 of the manifold block 38. As will be understood, the orifice fitting 84 and the nozzle 68 are sized such that the pressurized fuel gas is divided between the primary fuel gas conduit 70 and the secondary fuel gas tubing 78 in a desired ratio. The secondary fuel gas flowing through the tubing 78, the fitting 82, the orifice fitting 84 and into the internal passage 98 of the manifold block 38 flows by way of the internal passages 96 and 94 to the passages 90 and 92. From the passages 90 and 92, substantially equal portions of the secondary fuel gas flow through the discharge pipes 86 and 88 to within the furnace by way of the open ends thereof.

The primary fuel gas flowing through the conduit 70 is discharged in a high velocity jet by the nozzle 68 into the venturi formed by the bell fitting 56, the passage 51 in the manifold block 38 and the burner tube 34. As is well known by those skilled in the art, the flow of the jet of primary fuel gas into the venturi causes the aspiration of air, i.e., the production of a suction in the air conduit 58 which draws air from the atmosphere through the muffler 62 and through the conduit 58 into the bell fitting 56. The air mixes with the primary fuel gas as it and the primary fuel gas flow by way of the passage 51 in the manifold block 38 into and through the burner tube 34. The primary fuel gas-air mixture is discharged from the burner tube 34 through the longitudinal slots 42 thereof in directions generally parallel to the interior face 30 of the burner tile 12. The primary fuel gas-air mixture is ignited and combusted adjacent the face 30 of the burner tile 12 whereby the burner tile 12 is heated and radiates heat into the furnace to which the burner 10 is attached.

As will be understood by those skilled in the art, the burner 10 can be utilized in forced draft applications where the primary pressurized fuel gas and pressurized air are mixed in a manner whereby the fuel jet and venturi apparatus described above are not required. In such applications a premixed primary fuel gas-air mixture can be introduced directly into the bell fitting 56 or into the passage 51 of the manifold block 38.

A rate of air which is stoichiometric or greater than stoichiometric relative to the total rate of fuel gas (both primary and secondary fuel gas) is introduced into the furnace space by means of the burner 10. Preferably the rate of air is in the range of from about 7% to about 15% greater than the stoichiometric rate.

The primary fuel-air mixture discharged by way of the longitudinal slots 42 of the burner tube 34 contains excess air which, when the fuel gas-air mixture is combusted, functions to lower the temperature of the combustion reaction and the production of $NO_x$. The secondary fuel gas discharged into the furnace space by way of the open ends of the pipes 86 and 88 mixes with flue gases and air within the furnace space and also burns at a relatively low temperature which results in the total combustion gases produced by the burner 10 having a relatively low $NO_x$ level. The phrases "burns" or "is burned at a relatively low temperature" are used herein to mean that the combustion reaction temperature is lower than that which would occur if undiluted or stoichiometric mixtures of fuel gas and air were burned instead of the mixtures containing fuel gas described herein.

Of the total flow rate of fuel gas conducted to the burner 10, in the range of from about 60% to about 90% thereof is preferably primary fuel gas which is discharged into the furnace to which the burner 10 is connected by way of the burner tube 34. The secondary fuel gas flow rate discharged into the furnace by way of the pipes 86 and 88 is preferably in the range of from about 10% to about 40% of the total fuel gas flow rate. The most preferred flow rate of primary fuel gas is about 80% of the total fuel gas flow rate with the secondary fuel gas flow rate being about 20% of the total fuel gas flow rate.

As mentioned above, in order to insure that an unregulated flow of air does not leak into the passage 28 in the burner tile 12 and into the furnace space to which the burner 10 is connected, the manifold block 38 is sealingly connected by means of the sleeve 46 to the passageway 28. In the normal operation of the burner 10, the air passage 100 in the manifold block 38 is closed by the closure and regulating assembly 102 whereby no air flows into the furnace space by way of the passage 28 in the burner tile 12 and all of the air is discharged into the furnace to which the burner 10 is attached by way of the burner tube 34. However, in applications where the furnace draft or fuel gas pressure are low or other similar condition is encountered, and as a result a stoichiometric rate of air or greater relative to total fuel gas rate can not be drawn into the furnace by the venturi (formed by the fitting 56, passage 51 and burner tube 34) and the primary fuel jet produced by the nozzle 68, regulated supplemental air can be allowed to enter the furnace by way of the passage 100.

As also mentioned above, the burner tube 34 is of an elongated one-piece construction and is threadedly connected to the manifold block 38 at a position adjacent the exterior end of the passageway 28 in the burner tile 21. The burner tube 34 is most conveniently and economically cast formed of a metal alloy that has a high resistance to damage in furnace environments. However, when it is necessary to remove and replace the burner tube 34 as a result of corrosion or high temperature deterioration, the burner tube 34 can conveniently be threadedly removed and replaced. That is, because the threaded connection between the exterior end 36 of the burner tube 34 and the manifold block 38 is positioned at the exterior end of the passageway 28, it remains relatively cool. As a result, the threaded connection does not fuse and become inoperable as is the case when it is positioned near the interior end of the passageway 28. Also, the arrangement whereby a portion of the manifold block 38 is disposed within the sleeve 46 and is selectively movable therein allows the position of the manifold block 38 to be adjusted whereby the interior discharge end of the burner tube 34 is positioned at a desired location with respect to the face 30 of the burner tile 12 while the pipes 86 and 88 are maintained in their desired position relative to the burner tube 34.

The method of the present invention for burning fuel gas and air using the radiant gas burner 10 whereby flue gases of low $NO_x$ content are formed is comprised of the following steps:

(a) discharging a mixture of a primary portion of the fuel gas and substantially all of the air utilized into a furnace space by way of the burner tube 34 and longitudinal slots 42 thereof whereby the mixture contains excess air and is burned in the furnace space at a relatively low temperature and flue gases having low $NO_x$ content are formed therefrom, and (b) discharging the remaining secondary portion of the fuel gas directly into the furnace space by way of the pipes 86 and 88 from locations upstream of, but closely adjacent to the slots 42 of the burner tube 34 whereby the secondary portion of the fuel gas mixes with flue gases and air within the furnace space and also burns at a relatively low temperature whereby flue gases having low $NO_x$ content are formed therefrom.

In order to further illustrate the radiant gas burner and method of the present invention, the following example is given.

EXAMPLE

A burner apparatus 10 designed for a heat release of 1,000,000 BTU/hour by burning natural gas having a caloric value of 1,000 BTU/SCF is fired into a furnace space Pressurized fuel gas is supplied to the burner 10 at a pressure of about 30 PSIG and at a rate of 1,000 SCF/hour. An 80% portion of the total fuel gas (800 SCF/hour) flows into and through the assembly of the bell fitting 56, the manifold block 38 and burner tube 34 wherein it is mixed with air. The remaining portion of the fuel gas i.e., 200 SCF/hour, is discharged into the furnace space by way of the pipes 86 and 88. The rate of air introduced into the assembly of the bell fitting 56, manifold block 38 and burner tube 34 is controlled by means of the valve 66 such that the total rate of air is ten percent greater than the stoichiometric rate required for the total fuel.

Because of the excess air in the primary fuel gas-air mixture and the flue gases mixed with the secondary fuel gas and air, such mixtures burn at relatively low temperatures whereby the flue gases formed have a low $NO_x$ content. That is, the mixture of flue gases withdrawn from the furnace space 21 has a $NO_x$ content of less than about 25 ppm.

Thus, the present invention is well adapted to carry out the objects and attain the ends and advantages mentioned as well as those which are inherent therein. Numerous changes in the construction and arrangement of parts of the burner apparatus of the present invention may be made by those skilled in the art. For example, one or more orifices can be included within the passages of the manifold block 38 or other means can be utilized to proportion the fuel gas between the burner tube 34 and the pipes 86 and 88. Also, the burner tube 34 and the pipes 86 and 88 can be connected to separate flow rate regulated sources of fuel gas. Further, the burner tile can take various forms and can be replaced altogether by the refractory of the furnace wall with the burner tube and secondary fuel pipes extending through an opening therein. Such changes are encompassed within the spirit of this invention as defined by the appended claims.

What is claimed is:

1. In a radiant gas burner comprised of a refractory burner tile adapted to be inserted in a wall of a furnace and including an elongated passageway extending therethrough having an exterior end and an interior end, a burner tube disposed within the passageway having a nozzle positioned at the interior end of the passageway for directing a fuel gas-air mixture adjacent to the refractory burner tile within the furnace space, and means for introducing a fuel gas-air mixture into the burner tube attached thereto, the improvement which comprises:

said burner tube being of a one-piece elongated construction and being connected to said means for introducing a fuel gas-air mixture thereinto by a threaded connection positioned adjacent to the exterior end of said passageway whereby said threaded connection remains relatively cool during the operation of said burner and said burner tube thereby remains selectively threadedly removable;

said means for introducing a fuel gas-air mixture into said burner tube including a manifold block having a fuel gas-air mixture passage formed therein threadedly connected to said burner tube at one end and to a device for controlling the ratio of fuel to air at an opposite end, and means for sealingly connecting said manifold block to the exterior end of said burner tile passageway to thereby prevent the unregulated flow of air into said passageway attached to said burner tile and to said manifold block.

2. The improved radiant gas burner of claim 1 wherein said manifold block includes a secondary fuel gas passage formed therein connected to means for introducing fuel gas therein and connected to at least one secondary fuel gas discharge pipe disposed in said burner tile passageway.

3. The improved radiant gas burner of claim 2 wherein said means for sealingly connecting said manifold block to the exterior end of said burner tile passageway comprise:

a sleeve attached to the exterior end of said passageway; and at least a portion of said manifold block being of complimentary size and shape to the interior of said sleeve and being sealingly disposed within the interior of said sleeve.

4. The improved radiant gas burner of claim 3 wherein at least one resilient sealing member is disposed between the interior of said sleeve and the portion of said manifold block disposed therewithin.

5. The improved radiant burner of claim 3 wherein said manifold block includes an air passage formed therein which communicates with the interior of said burner tile passageway, and means for regulating the air flow into said air passage are attached to said manifold block over said air passage.

6. An improved radiant gas burner comprising:

a burner tile mounting plate having an opening therein and supporting a refractory burner tile adapted to be connected in a wall of a furnace space, said burner tile having an elongated central passageway extending therethrough which is complimentary to said opening in said mounting plate;

a sleeve sealingly attached to said opening in said mounting plate;

a primary fuel gas-air mixture and secondary fuel gas manifold block sealingly connected to said sleeve whereby unregulated air flow is prevented from entering said passageway in said burner tile;

a one-piece elongated burner tube disposed within said burner tile passageway having an inlet end threadedly connected to said manifold block and having a closed outlet end with a plurality of circumferentially spaced openings formed therein for directing a primary fuel gas-air mixture adjacent to said refractory burner tile within said furnace space;

at least one secondary fuel gas discharge pipe connected to said manifold block and having the discharge end thereof positioned adjacent to the outlet end of said burner tube for injecting secondary fuel gas into said furnace space;

means for introducing a primary fuel gas-air mixture into said manifold block and into said burner tube; and means for introducing secondary fuel gas into said manifold block and into said secondary fuel discharge pipe.

7. The improved radiant gas burner of claim 6 wherein at least a portion of said manifold block is sealingly disposed within said sleeve.

8. The improved radiant gas burner of claim 7 wherein at least one resilient sealing member is disposed between the interior of said sleeve and the portion of said manifold block disposed therewithin.

9. The improved radiant gas burner of claim 8 wherein said resilient sealing member is an O-ring.

10. The improved radiant gas burner of claim 9 wherein said manifold block includes an air passage formed therein which communicates with the interior of said burner tile passageway, and means for regulating the air flow into said air passage are attached to said manifold block over said air passage.

11. The improved radiant gas burner of claim 10 wherein said burner includes two of said secondary fuel gas discharge pipes positioned on substantially opposite sides of said burner tube.

12. The improved radiant gas burner of claim 11 wherein said means for introducing a primary fuel-air mixture into said manifold block are comprised of a fuel and atmospheric air venturi mixer connected to said manifold block having an atmospheric air inlet and a fuel gas nozzle adapted for connection to a source of pressurized fuel gas.

13. The improved radiant gas burner of claim 12 wherein said means for introducing secondary fuel gas into said manifold block are comprised of a conduit connected to said manifold block and adapted for connection to a source of pressurized fuel gas.

* * * * *

UNITED STATES PATENT AND TRADEMARK OFFICE

CERTIFICATE OF CORRECTION

PATENT NO. : 5,180,302

DATED : January 19, 1993

INVENTOR(S) : Robert E. Schwartz et al

It is certified that error appears in the above-identified patent and that said Letters Patent is hereby corrected as shown below:

On the title page, item [54] and in column 1, line 2, in the title delete the words "and Method".

Column 8, line 58, delete the word "are".

Signed and Sealed this

Ninth Day of November, 1993

*Attest:*

*Attesting Officer*

BRUCE LEHMAN

*Commissioner of Patents and Trademarks*